US005457969A

United States Patent [19]

Roaf

[11] Patent Number: 5,457,969

[45] Date of Patent: Oct. 17, 1995

[54] TOP LOADING VERTICAL AXIS WASHING/DRYING MACHINE

[75] Inventor: Steven D. Roaf, Dallas, Tex.

[73] Assignee: Roaf Industries, Inc., Dallas, Tex.

[21] Appl. No.: 380,043

[22] Filed: Jan. 30, 1995

[51] Int. Cl.[6] ..... D06F 25/00

[52] U.S. Cl. ..... 68/19.2; 68/133; 68/19.1

[58] Field of Search ..... 68/19.2, 207, 183, 68/13, 20, 133, 131, 19.1

[56] References Cited

U.S. PATENT DOCUMENTS

| | | | |
|---|---|---|---|
| 2,314,155 | 3/1943 | McCleary | 68/19.2 X |
| 2,553,581 | 5/1951 | Hatfield | 68/183 X |
| 2,893,135 | 7/1959 | Smith | 34/75 |
| 2,986,916 | 6/1961 | Bognan | 68/19.2 |
| 3,091,955 | 6/1963 | Taylor et al. | 68/19.2 |
| 3,376,718 | 4/1968 | Kahn | 68/4 |
| 4,903,508 | 2/1990 | Durazzani et al. | 68/4 |
| 5,000,015 | 3/1991 | Nakamura et al. | 68/23.3 |
| 5,058,401 | 10/1991 | Nakamura et al. | 68/19.2 |
| 5,074,131 | 12/1991 | Hirose et al. | 68/19.2 |
| 5,111,673 | 5/1992 | Kadoya et al. | 68/12.04 |
| 5,161,394 | 11/1992 | Felzer et al. | 68/207 |

FOREIGN PATENT DOCUMENTS

| | | | |
|---|---|---|---|
| 735167 | 5/1966 | Canada | 68/19.2 |
| 3-202097 | 9/1991 | Japan | 68/19.2 |

*Primary Examiner*—Frankie L. Stinson
*Attorney, Agent, or Firm*—Darby & Darby

[57] ABSTRACT

A washing/drying machine has a top loading, wash type inner tub which is rotatable about a vertical axis and accommodates clothes during both a washing and drying cycle. The inner tub is positioned within a vertically arranged outer tub which is capable of storing water for the wash cycle. An agitator is provided within the inner tub adjacent to its lower closed end and has an outer diameter close to an inner diameter of the inner tub. A motor is disposed outside of the inner and outer tubs and selectively rotates the agitator in sequential clockwise and counter-clockwise motions during the washing cycles. A dryer is disposed outside of and connected to the inner and outer tubs by first and second air passages which direct drying air to a space between the inner and outer tubs, and the open end of the inner tub. During the drying cycle, the motor rotates the agitator and inner drum in opposite directions so the damp clothes, which tend to rest at the bottom of the inner tub, are tossed up into the drying air to promote uniform drying. Also, the agitator flanges may be curved to enhance their ability to scoop up the damp clothes during the drying cycle and toss them in the air.

10 Claims, 2 Drawing Sheets

TOP LOADING VERTICAL AXIS WASHING/DRYING MACHINE

FIELD OF THE INVENTION

This invention relates in general to a washing/drying machine capable of successively performing washing and drying operations and, more particularly, to a top loading washing/drying machine which operates in a vertical orientation during both the washing and drying operations.

BACKGROUND OF THE INVENTION

Washing/drying machines typically comprise four configurations: 1) vertical-axis; 2) horizontal-axis; 3) vertical-axis rotatable to a horizontal or inclined axis and 4) inner and outer washing and drying tubs wherein the washing tub remains vertical while the drying tub remains horizontal.

U.S. Pat. No. 3,376,718 to Kahn, issued Apr. 9, 1968, discloses the first type of washing/drying laundry machine which comprises a vertical water container, a perforated dehydrating tub supported in the water container for rotating about a vertical axis, and an agitator rotatably supported in the dehydrating tub. To wash and rinse the laundry, the laundry is loaded in the water container, water is supplied to the water container, and the agitator is rotated. Subsequently, water is drained from the water container, and the dehydrating tub is rotated at high speed to dehydrate the laundry. In this configuration, the tub remains in a vertical orientation through the washing and dehydrating process. Air for drying is injected into the tub from above and is exhausted at the base.

U.S. Pat. No. 5,029,458 to Obata et al., issued Jul. 9, 1991, discloses the second type of washing/drying laundry machine which comprises a horizontal water container and a horizontal perforated rotation tub. The rotation tub is supported in the water container so that the tub can rotate about a horizontal axis. After the laundry is loaded in the rotation tub and water is supplied to the water container, the rotation tub is rotated to wash and rinse the laundry. Subsequently, water is drained and the rotation tub rotates at high speed to dehydrate the laundry. In this configuration, the tub remains in a horizontal orientation throughout both the washing and drying process.

U.S. Pat. No. 5,074,131 to Hirose et al., issued Dec. 24, 1991, discloses the third type of washing/drying laundry machine which comprises a vertical water container and a vertical perforated rotation tub. The rotation tub is supported in the water container so that the tub can rotate about a vertical axis. After the laundry is loaded in the rotation tub and water is supplied to the water container, the rotation tub is positioned with an inclined orientation where it is rotated to wash and rinse the laundry. Subsequently, water is drained and the rotation tub rotates at high speed to dehydrate the laundry. In this configuration, the tub is in a vertical position during the washing cycle and in an inclined position during the drying cycle when air is injected into the tub from its opening end, which is located slightly above horizontal.

U.S. Pat. No. 5,058,401 to Nakamura et al. issued Oct. 22, 1991 discloses the fourth type of washing/drying laundry machine which comprises a water tub, a ring supported in the water container for rotating about a vertical axis, a perforated spherical container supported in the ring for rotating about a horizontal axis, a drive means for rotating the spherical container and the ring, and a change means for controlling the drive means and for choosing between the horizontal and the vertical rotations of the spherical container and the ring. After the laundry is loaded in the spherical container and water is supplied to the water tub, only the container rotates about the horizontal axis to wash the laundry. Subsequently, in order to dehydrate the laundry, the water is drained and the ring and the container rotate about the vertical axis at high speed. Warm air for drying is introduced along a horizontal axis of the spherical container. In this configuration, the tubs remain in their original orientations, vertical during the washing cycle and horizontal during the drying cycle.

The present invention relates to the first type of washing/drying machine which remains vertical. The primary design flaw of this type of machine is its inability to properly agitate the clothes in the vertical tub during the drying cycle. After the laundry is washed, the laundry is generally entangled and accumulates in the bottom of the rotation tub. Since the tub in a vertical orientation, drying the clothes evenly is difficult. Even when the tub is rotated, as in a dehydrating cycle, the clothes tend to stick to the side.

A solution to the vertical tub drying operation would be to utilize a horizontal tub for washing and drying, i.e., the second type of machine. This second type of washing/drying machine requires less water and has less entangled laundry than the first laundry machine. However, during rotation, the horizontal-axis tub loses its balance and vibrates due to the unbalanced load of the laundry, thus generating noise. Corrective weights, for preventing the noise, make the laundry machine heavier and manufacturing costs higher. However, horizontal tubs are notorious for leaking. Similarly, if the latch of a horizontal tub washing/drying machine fails or is accidentally disengaged, the entire contents of the tub will empty into the room.

A solution to the all vertical and all horizontal operations would be to utilize a vertical mechanism rotatable wash tub that can be moved to an inclined or horizontal position for drying, i.e., types 3 or 4. However, this movement requires complex parts, adding significant costs and potential for failure.

SUMMARY OF THE INVENTION

Accordingly, it is an object of the present invention to provide an improved top loading, vertical axis washing/drying machine.

It is a further object of the invention to provide relatively even drying of the clothes in a vertical inner tub of the machine.

It is a still further object of the invention to provide agitation of the clothes during a drying operation in a vertical inner tub.

In carrying out the above and other objects of the invention in one form, there is provided a washing/drying machine which comprises a top loading, vertical axis inner tub for accommodating clothes during washing and drying cycles. The inner tub comprises a hollow cylinder-shaped mesh screen having a closed end and an opposite open end for allowing the clothes to be transferred into and out of the inner tub. The inner tub is positioned within a vertical axis outer tub, both of which are supported by a frame. The outer tub is capable of storing water. An agitator is provided within the inner tub adjacent to the closed end and has an outer diameter close to an inner diameter of the inner tub. The flanges of the agitator are curved so as to lift the clothes from the bottom and sides of the inner tub enabling the hot air to circulate around the clothes. A motor is disposed outside of the inner and outer tubs for selectively rotating the agitator and inner tub in a clockwise and counterclockwise direction during the washing and drying cycles. A dryer is disposed outside of and connected to the inner and outer tubs by first and second air passages, a first end of the air passages is in communication with the dryer and a second end of the air passages is in communication with a space between the inner and outer tubs and the open end of the inner tub.

BRIEF DESCRIPTION OF THE DRAWINGS

The foregoing and other features of the present invention will be more readily apparent from the following detailed description and drawings of illustrative embodiments of the invention in which.

DETAILED DESCRIPTION OF THE DRAWINGS

Figure 1:
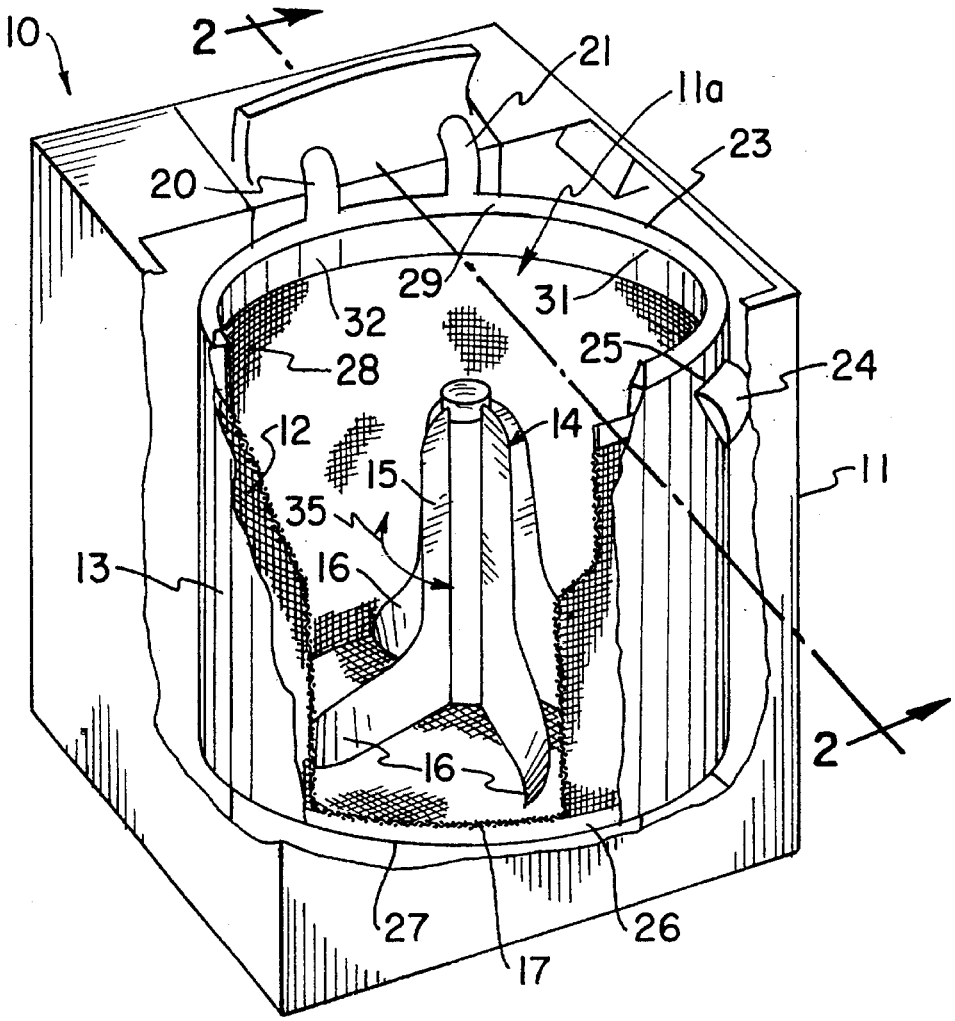
FIG. 1 is a perspective view of the preferred washing/drying machine according to the present invention.
Figure 2:
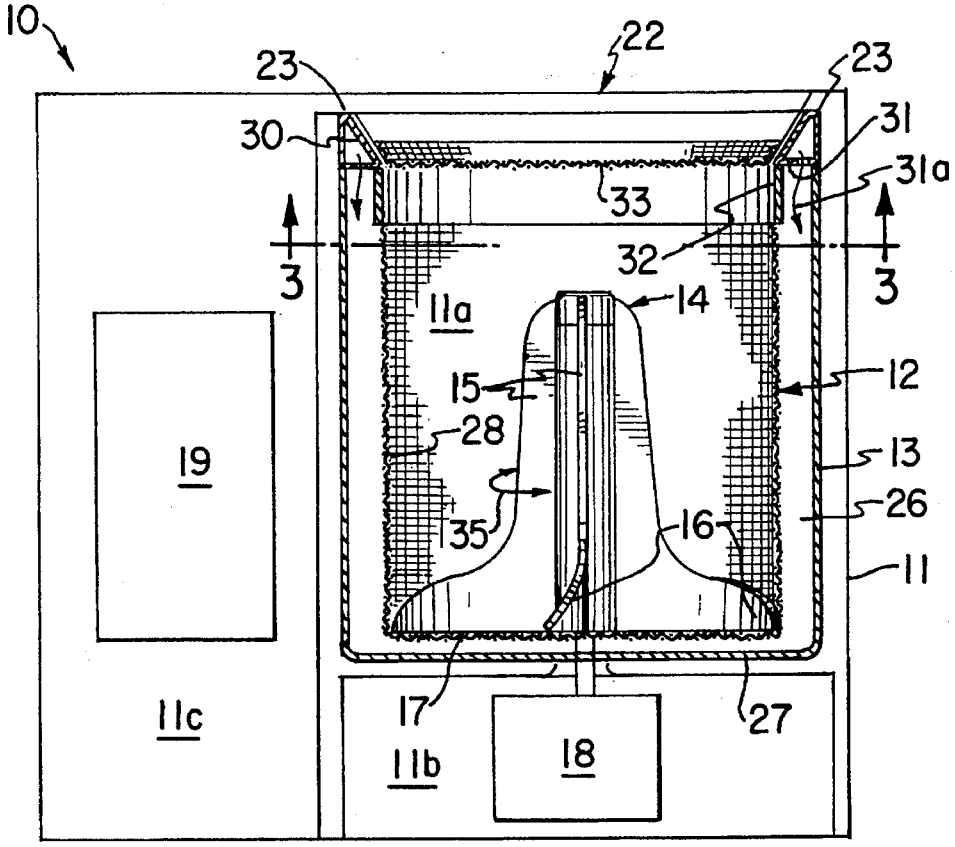
FIG. 2 is a side sectional elevation view of the preferred washing/drying machine according to the present invention along line 2—2 in FIG. 1.

Referring to FIGS. 1–2, a preferred top loading, vertical axis washing/drying machine 10 comprises a box-like aluminum or stainless steel body 11 having a washing/drying chamber 11*a*, a washer motor housing chamber 11*b* and a dryer motor housing chamber 11*c*. The body 11 supports inner and outer robs 12 and 13 within the washing/drying chamber 11*a* by suspension rods and vibrational isolation springs (not shown) as is well known in the art. The outer tub 13 is air and water tight and houses the water and the hot air required for the inner tub 12. Both tubs 12 and 13 remain in a vertical orientation during the washing and drying cycles. The body 11 comprises aluminum or stainless steel and is insulated to prevent overheating of the outside walls of the machine 10 during the drying cycle.

Figure 1A:
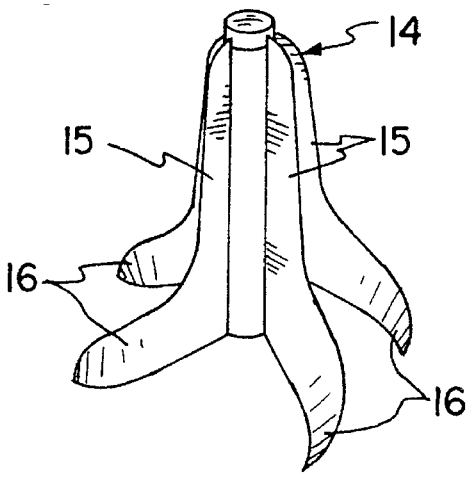
FIG. 1*a* is a perspective view of the preferred agitator according to the present invention.

Referring to FIG. 1*a*, the machine 10 has an agitator 14 which comprises four flanges 15 having extended portions 16 of a sufficient angle to upwardly lift the clothes from a bottom surface 17 and walls 28 of the inner tub 12 during the drying cycle. The flange portions 16 may be perpendicular to the bottom surface 17 of the inner tub 12 without deviating from the intent of the invention. The agitator 14 is driven by a motor 18 positioned below the inner tub 12 within the motor housing chamber 11*b*. Unlike a conventional washing/drying system, the inner tub 12 spins at a greater velocity than a standard washing machine tub during the washing cycle and spins at a slower velocity during the drying cycle.

An air dryer 19 is located behind the machine 10 in the dryer motor housing chamber 11*c*. The dryer 19 is similar to a conventional clothes dryer but utilizes a larger motor which preferably blows approximately 58,329 feet of hot air per minute. The dryer 19 utilizes heating elements of 240 volts and 5600 watts and will blow 70% more hot air than a conventional dryer. The dryer 19 is also equipped with a 30 amp circuit breaker as in a conventional dryer.

The dryer 19 is connected to twin air hoses 20 and 21 which dispense hot air into a circular hose 23 positioned along the top of the outer tub 13. The inner and outer tubs 12 and 13 are positioned to provide a space 26 between the inner tub 12 and the outer tub 13 of approximately ½ to ¾ inch wide, which allows hot air from the dryer 19 to circulate between the tubs 12 and 13 during the drying process. A hose 25 is provided within chamber 11*a* which allows the air from the inner tub 12 to escape through a lint filter 24, positioned between the circular hose 23 and the inner tub 12.

Figure 3:
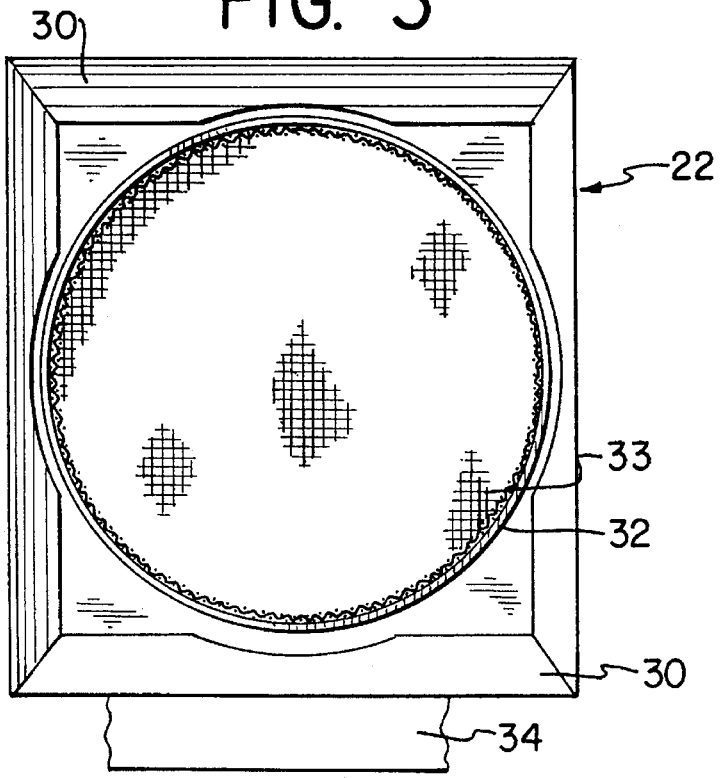
FIG. 3 is a bottom sectional view of the drying hood of the washing/drying machine according to the present invention along line 3—3 in FIG. 2.

Referring to FIGS. 2 and 3, the air dryer 19 also supplies hot air to a drying hood 22 which comprises a circular vent 33 and fits over the inner tub 12. A rubber tracking (not shown) is provided on the slanted surfaces 30 of the hood 22 and engage the slanted surfaces 29 of the circular hose 23, thus creating an air fight seal. The circular vent 33 comprises a series of smaller vents angled in different directions to ensure that the hot air channeled from the dryer 19 through a large flexible hose 34, is directed to all areas of the inner tub 12. The circular vent preferably comprises aluminum or stainless steel.

The circular hose 23 thrusts air from a bottom surface 31 of the hose 23 in a direction 31*a* to the space 26, thus providing hot air circulation between the inner and outer tubs 12 and 13. A panel 32 is provided below the circular hose 23 which directs the hot air downward in the direction 31*a* along the sides 28 towards the bottom surface 17 of the inner tub 12. The inner tub 12 comprises a screen-like mesh, preferably, a wire screen-like mesh which allows air to flow from the space 26 through the sides 28 and the bottom 17 of the inner tub 12.

A lint filter hose 25 and the air supply hoses 21 and 22 are positioned higher along the sides 28 of the inner tub 12 than an upper end of a water overflow valve (not shown), thereby preventing washing water from flowing to electrical sections of the machine, including the drying motor 19. The overflow valve is connected to a drain hose (not shown) thereby enabling overflow water to be discharged, as is well known in the art. Furthermore, a water supply hose (not shown) is connected to an external water supply source through a water supply valve as is also well known in the art. A water level indicator (not shown) allows the water to fill to the level of the panel 32 as is well known in the art.

The washing steps and drying steps of the washing/drying cycles comprise one continuous process which may be controlled together or in combination, automatically using a timer or manually. During each washing/drying cycle, the washing process includes washing, rinsing and dehydrating as is well known in the art. However, unlike the prior art, the inner and outer tubs 12 and 13 are held in a vertical orientation as shown in FIGS. 1 and 2.

During the washing cycle, the inner tub 12 spins at a faster rate than a conventional washer and removes approximately 20% more water from the clothes than the spin cycle of a conventional washer. This is accomplished by spinning the inner tub 12 at a faster rate and/or for a longer period of time than a conventional washer. The length of washing/rinsing/dehydrating and drying cycles may be varied by selecting various pre-set cycles on the machine's control panel (not shown) as is well known in the art or may be manually operated using a separate timer as is also well known.

In operation, the hood 22 is opened and clothes are placed into the inner tub 12, afterwhich the hood 22 is closed. The clothes are washed and dried within the inner tub 12. Thereafter, the washed and dried clothes can be taken out from the inner tub 12 of the machine 10, eliminating the need for a separate washing and drying machine. In addition, since the inner and outer tubs 12 and 13 remain in the vertical orientation during both the washing and drying cycles, the inner and outer tubs 12 and 13 do not require rotation towards the horizontal axis as with the prior art. Therefore, the preferred washing/drying machine 10 requires fewer moving parts, is less complex and has a higher drying efficiency than the prior art.

During the drying process, both the agitator 14 and the inner tub 12 are rotated by the motor 18. As both the agitator 14 and the inner tub selectively rotate in a clockwise and counterclockwise direction, as shown by arrow 35, the clothes in the inner tub 12 are lifted upward over the preferably angled flange portion 16 of the agitator and naturally fall to a rotated position relative to the position from which they are first moved upwardly. Turning the agitator and inner tub in opposite directions enhances the ability of the angled flanges to scoop up the damp clothes from the bottom of the inner tub or the lower portions of its sides, and toss them up into the chamber 11*a*. The clothes can therefore be mixed suitably and their positions always changed with respect to each other to ensure that the clothes are uniformly subjected to the blown hot air from the dryer. This enables the clothes to be uniformly dried without removing the clothes from the inner tub 12.

While the embodiment of the invention shown and described is fully capable of achieving the results desired, it is to be understood that this embodiment has been shown and described for purposes of illustration only and not for purposes of limitation. Therefore, the invention is limited only by the appended claims.

What is claimed is:

1. A washing/drying machine comprising:

an inner tub rotatable about a generally vertical axis, said inner tub accommodating an object during a washing and drying cycle, said inner tub comprising a hollow cylinder shaped mesh screen having a closed end and an opposite open end;

an outer tub rotatable about a generally vertical axis and receiving said inner tub therein, said outer tub being capable of storing water therein and having an open end closable by a hood;

an agitator provided within said inner tub adjacent to said closed end, thereof, said agitator having an outer diameter close to an inner diameter of said inner tub;

a motor device disposed outside of said inner and outer tubs which is connected to the inner tub and agitator so as to selectively rotate said agitator and said inner tub during the washing and drying cycles, said agitator rotated in successive clockwise and counter clockwise motions with respect to said inner tub during said washing cycle, and said agitator and said inner tub selectively rotated in opposite directions during said drying cycle; and a dryer disposed outside of and connected to an air discharge in the hood and a space between said inner and outer tubs by first and second air passages.

2. The washing/drying machine of claim 1, further comprising a body for supporting said inner and outer tubs and a suspension which suspends said tubs within said body.

3. The washing/drying machine of claim 1, further comprising an air circulating passage including a passage portion extending from said open end of said inner tub to a bottom of said inner tub through an interior of said inner tub, and a passage portion extending from said bottom of said inner tub from said open end of said inner tub through said air passage.

4. The washing/drying machine of claim 3, further comprising a blower provided in said air passage.

5. The washing/drying machine of claim 4, further comprising a heater provided in said air passage on a downstream side of said blower for heating air flowing from said air passage.

6. The washing/drying machine of claim 5, wherein said blower channels air above said inner rob.

7. The washing/drying machine of claim 1, wherein said inner tub is agitated during said drying cycle to propel said object upwardly from said closed end toward said open end thereof.

8. The washing/drying machine of claim 1, wherein said agitator comprises at least one flange.

9. The washing/drying machine of claim 8, wherein said at least one flange is rotated about said generally vertical axis.

10. The washing/drying machine of claim 9, wherein said at least one flange is substantially angled.

* * * * *